US009320305B1

(12) United States Patent
Berger

(10) Patent No.: US 9,320,305 B1
(45) Date of Patent: Apr. 26, 2016

(54) GARMENT HAVING INTEGRATED BREAST SUPPORT

(71) Applicant: Wild Intuitions, LLC, Sudbury, MA (US)

(72) Inventor: Melanie Berger, Sudbury, MA (US)

(73) Assignee: Wild Intuitions, LLC, Sudbury, MA (US)

( * ) Notice: Subject to any disclaimer, the term of this patent is extended or adjusted under 35 U.S.C. 154(b) by 346 days.

(21) Appl. No.: 14/021,539

(22) Filed: Sep. 9, 2013

Related U.S. Application Data

(60) Provisional application No. 61/698,678, filed on Sep. 9, 2012.

(51) Int. Cl.
*A41C 3/08* (2006.01)

(52) U.S. Cl.
CPC ..... *A41C 3/08* (2013.01)

(58) Field of Classification Search
CPC ..... A41C 3/00; A41C 1/11; A41C 3/144; A41C 3/148; A41C 3/14
USPC ..... 450/30–33, 54–57, 58, 39
See application file for complete search history.

(56) References Cited

U.S. PATENT DOCUMENTS 3,746,007 A * 7/1973 Hand ..... A41D 10/00 2/73
4,372,320 A * 2/1983 Silber ..... A41C 3/08 2/67
4,781,650 A * 11/1988 Budd ..... A41C 3/148 450/30
6,443,805 B1 * 9/2002 Kirkwood ..... A41C 3/0035 450/31
6,530,820 B1 * 3/2003 Katze ..... A41C 3/08 450/30
8,403,724 B1 3/2013 Chapin
8,900,032 B2 * 12/2014 Punsal ..... A41C 3/0057 450/17
2003/0157866 A1 * 8/2003 Horii ..... A41D 7/00 450/31
2008/0194179 A1 * 8/2008 Leung ..... A41C 3/08 450/31
2008/0229474 A1 * 9/2008 Fons ..... A41B 9/08 2/113
2009/0265830 A1 * 10/2009 Hendrickson ..... A41D 1/205 2/104
2009/0265831 A1 * 10/2009 Hendrickson ..... A41C 3/04 2/104
2011/0092133 A1 * 4/2011 Livingstone ..... A41C 3/08 450/31
2011/0281497 A1 * 11/2011 Van Dorp ..... A41C 3/148 450/31
2012/0142252 A1 * 6/2012 Hopkins ..... A41C 3/08 450/31
2012/0190271 A1 * 7/2012 Livingstone ..... A41D 13/0017 450/31
2014/0141692 A1 * 5/2014 Yuasa ..... A41C 3/08 450/30

* cited by examiner

*Primary Examiner* — Gloria Hale
(74) *Attorney, Agent, or Firm* — Kuta Intellectual Property Law, LLC; Christine M. Kuta

(57) ABSTRACT

Soft and flexible breast support elements are integratable into loungewear and sleepwear such that comfortable support and shaping are provided. The structure and placement of bra cups provides soft support while an arrangement of elastic elements maintains the position of the breast support elements without wires or fasteners.

12 Claims, 7 Drawing Sheets

GARMENT HAVING INTEGRATED BREAST SUPPORT

BACKGROUND

There has been continuing interest in the apparel industry to develop brassieres (also referred to as "bras") and other support garments that provide a supporting effect to the bust in addition to other effects such as lifting and shaping. Generally, a brassiere constructed to bear the weight of, and to support and to provide shape to the bust is comfortable only for limited periods of time. A typical brassiere includes cups for the breasts. The cups are held in place on the chest by a strap extending around the torso and by shoulder straps fastened to the tops of the cups and to the torso strap at the back of the torso. Fasteners are often found on the torso strap at the back but may also be found in the front between the two cups. The cups also often include support features such as underwire and other sections of the brassiere may include boning for additional shaping.

Typically, women want to wear such a garment for only part of the day but want to maintain the supporting and shaping features provided by such a garment. Further, it is typically uncomfortable and often inadvisable for health reasons to wear a conventional bra while sleeping. Accordingly, it remains desirable to have a garment that provides the features of support and shaping with the comfort and flexibility of more relaxed apparel such as a nightgown or loungewear.

SUMMARY

The problems of providing comfortable breast support in a leisure wear garment are solved by the present invention of integrated breast support elements that are soft and flexible.

Women's lounge wear and sleepwear such as camisoles, nightgowns and tops include integrated breast support elements that are soft and flexible having a form and configuration that provide support and shaping in a comfortable arrangement.

In a first embodiment, a garment including a breast support function has a garment front, a garment back, a first side, a second side and first and second shoulder portions disposed and joined to define the inside of the garment. The garment further includes a first and a second shaped cup for receiving breasts of a wearer of the garment where each shaped cup has an inner edge, an outer edge, a bottom edge and a top section. The garment includes a bridge located between the first and second shaped cups and attached to the inner edge of each shaped cup, and a first wing attached to the outer edge of the first shaped cup and a second wing attached to the outer edge of the second shaped cup. The first wing is also coupled to the first side of the garment and the second wing is coupled to the second side of the garment. The garment still further includes a first strap attached to the top section of the first shaped cup and a second strap attached to the top section of the second shaped cup where the first strap is coupled to the first shoulder portion and the second strap is coupled to the second shoulder portion. An elastic section is integrated into the garment back starting at the first side and extending to the second side. By integrating breast support elements into a garment, the garment provides breast shape and support with comfort and east of movement. The cups contain and shape the breasts and are held in place over the breasts inside the garment substantially without compression, and without hard components such as wires or fasteners.

In a first arrangement, each shaped cup includes a lining layer, an outer fabric layer and a foam layer disposed between the lining layer and the outer fabric layer. The foam layer provides support and shaping. In some embodiments of the garment, the foam is a polyester foam. The inner and outer fabric layers contain the foam and hold it in place as well as provide comfortable surfaces for wearability. In a second arrangement, the foam layer is dome-shaped and the lining layer and outer layer are shaped to conform to the foam layer. In a third arrangement, each shaped cup includes a first lower section and a second lower section to provide breast support and an upper section.

In an alternative embodiment, each shaped cup includes a piece of fleece tape along the bottom edge. The tape reinforces the cup and also provides a soft alternative that performs in a similar manner to the underwire of conventional brassieres.

In a further alternative embodiment, the bridge is made of a non-elastic material. In a still further alternative embodiment, the first wing and the second wing are made of a flexible material held in place by an elastic strip at the base of the wing.

In another alternative embodiment, the elastic section integrated into the garment back is a strip of elastic material sewn to the garment back. In an alternative arrangement, the elastic section integrated into the garment back is a section stitched with elastic thread.

In a further alternative embodiment, the outer fabric layer is the garment front.

In another alternative embodiment, the elastic section integrated into the back of the garment is located in alignment with the first wing and the second wing.

The present invention together with the above and other advantages may best be understood from the following detailed description of the embodiments of the invention illustrated in the drawings, wherein:

DRAWINGS

DESCRIPTION

Embodiments of the present invention include garments having the characteristics of shape and support with comfort and flexibility. The garments include shaping and supportive elements integrated into loungewear or sleepwear resulting in the comfort and flexibility of, for example, sleepwear. Other types of garments include camisoles, sleeveless nightgowns, sleeveless tops, short sleeve tops, and ¾ sleeve tops. The garments have integrated into them a shaped breast support without hard components or fasteners or compression that enables the wearer to lounge and/or sleep in comfort. One embodiment includes a nightgown with brassiere cups that provide support, flexibility and softness to the garment in the bust, and significantly improves the aesthetic appearance of woman's breasts in loungewear/sleepwear.

Figure 1:
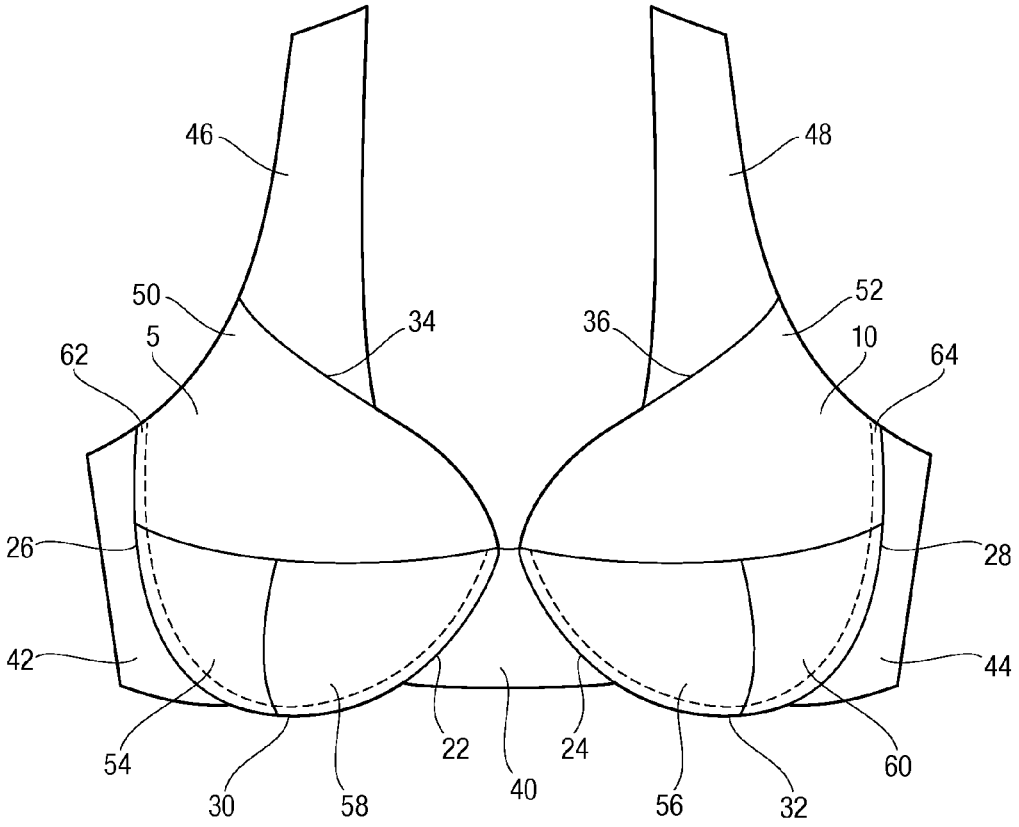
FIG. 1 is a front view of a first embodiment of breast support elements according to principles of the invention.
Figure 2:
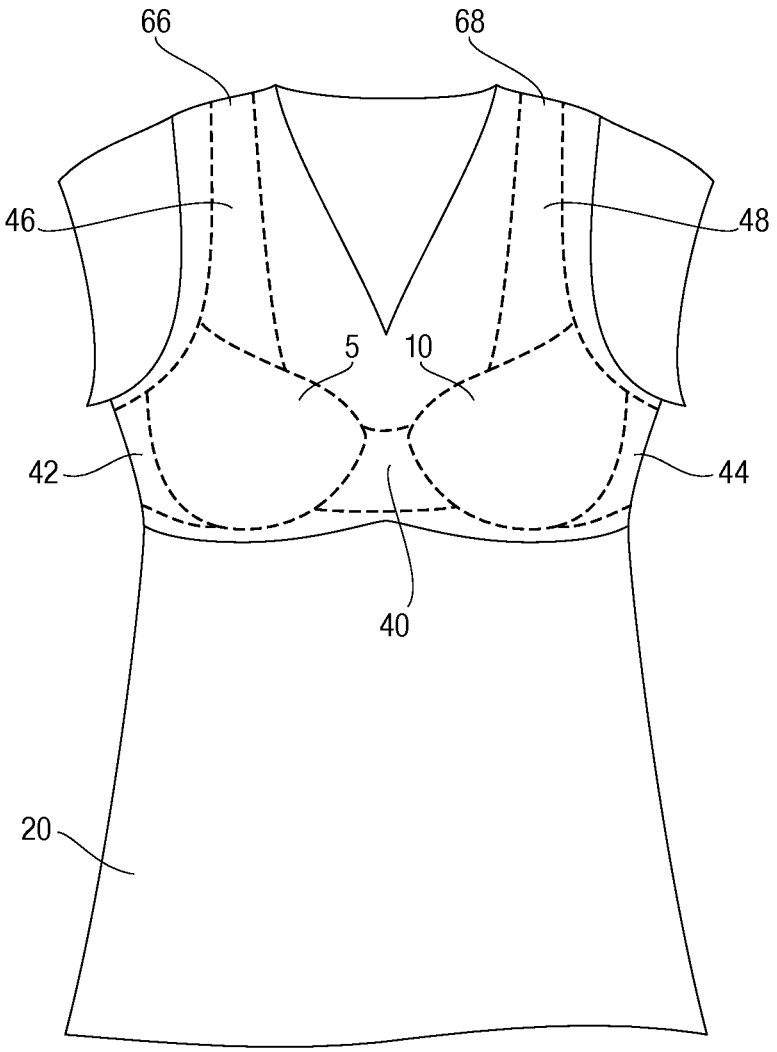
FIG. 2 is a front view of a garment incorporating the breast support elements shown in FIG. 1.

FIG. 1 is a front view of a first embodiment of breast support elements formed and configured to be incorporated into a loose-fitting garments such as a nightgown, top, or camisole. FIG. 2 is a front view of a garment incorporating the breast support elements of FIG. 1.

The breast support elements include two cups 5, 10 for receiving the breasts of the wearer of the garment 20. Each cup has an inner edge 22, 24, an outer edge 26, 28, a bottom edge 30, 32 and a top section 34, 36. A bridge 40 between the two cups 5, 10 is attached to the inner edges 22, 24 of the cups 5, 10. A first wing 42 is attached to the outer edge 26 of one cup 5 and a second wing 44 is attached to the outer edge 28 of the other cup 10. A first strap 46 is attached to the top section 34 of one cup 5 and a second strap 48 is attached to the top section 36 of the second cup 10.

The cups 5, 10 are shaped and configured to receive breasts. In the present embodiment, each cup has three sections: an upper section 50, 52 and two lower sections 54, 56, 58, 60. The sections 50, 52, 54, 56, 58, 60 are formed and configured such that the lower sections 54, 56, 58, 60 provide breast support and the upper sections 50, 52 provides shaping to the breast. The lower sections sustain most of the loading for breast support. The top sections define the volume of the cup and serves to form the line of the cleavage. The uniqueness of the cup's cut is defined by the diagonal arrangement of the lower sections in relation to the breast line which is defined as the horizontal line through the breasts. The lower sections are arranged such that the lower part of the breast is supported, and this support continues up the outer sides of each breast. This helps to form a rounded shape of the breasts, impedes displacement of the breasts to the side, and helps to enhance cleavage by positioning and supporting the breasts in a more upright position. The top section of each cup is additionally supported through the shoulder strap.

Figure 4:
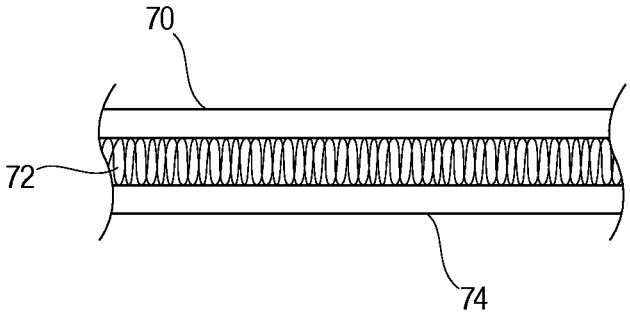
FIG. 4 is a cross-sectional view of the layers of a cup of the breast support elements of FIG. 1.

Each cup 5, 10 has three layers, shown in cross-section in FIG. 4. The cups have an outer layer 70, an inner 74 or lining layer, and an interfacing layer 72. The outer and inner layers are fabric, preferably a soft fabric. The interfacing layer 72 is a layer of foam. The layer of foam is, for example, a polyester foam with a thickness of, for example, ⅛ inch. The foam serves to achieve a volume-enhanced shape and, at the same time, creates softness and flexibility. In the present embodiment, the foam is cut and sewn in three sections in order to form the cups. In alternative embodiments, fewer or more sections of foam are used. In an alternative arrangement, the foam is cut and molded into curved sections which are sewn together to form the cups. In an alternative embodiment of the garment, the front of the garment forms the outer layer 70 of the breast support elements.

Each cup in the embodiment shown in FIG. 1 further includes a channel 62, 64, such as a piece of fleece tape, attached at the inside of the cup. The channel extends from the inner edge, all along the bottom edge, and along the outer edge of the cup. The channel provides soft support in a manner similar to the underwire in a conventional brassiere. In contrast to conventional brassieres, the cup in the present embodiment includes no hard components. For example, the cups of the present embodiment have no metal semicircular underwires commonly inserted in the bottom seams of bras. Instead, soft fleece tape is used for reinforcement on the bottom edge of each cup. The tape in this arrangement improves resistance of the cup to the weight of the breast and at the same time is not a constricting structure.

The bridge 40 holds the two cups together and also in place on the chest. The bridge is made of a stabilizer fabric or some type of non-elastic fabric. In any case, the bridge has limited flexibility to keep breasts in place.

Figure 7:
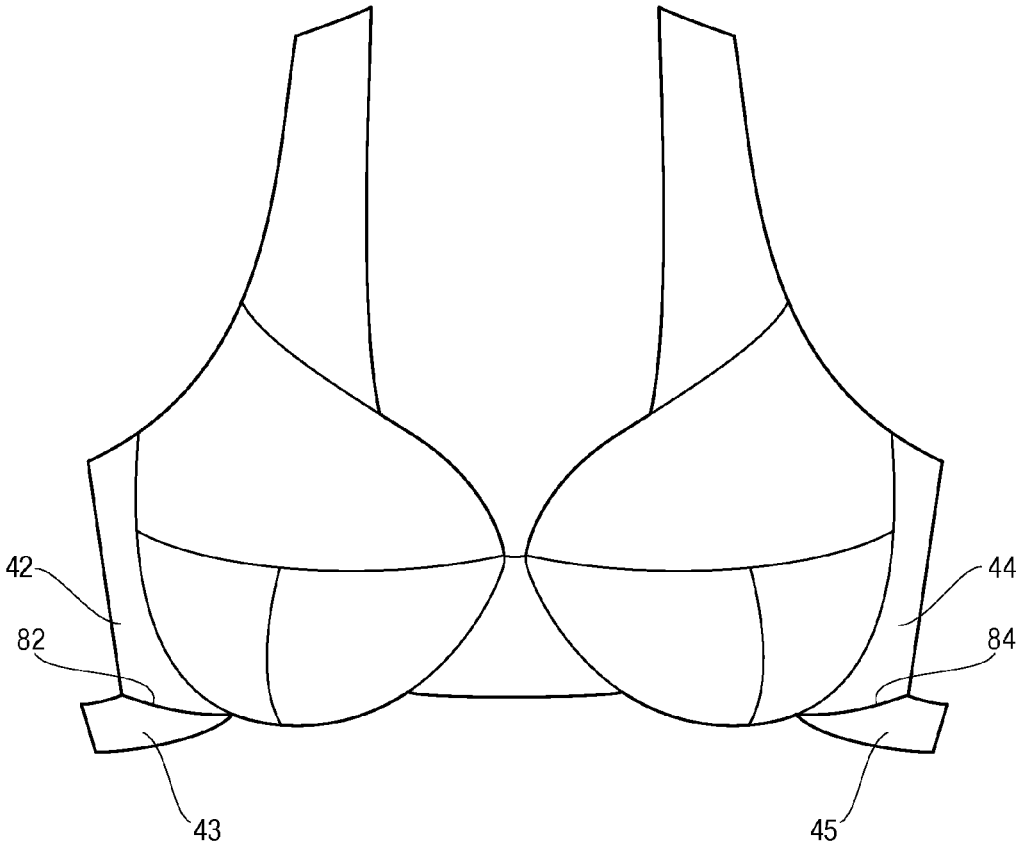
FIG. 7 shows an alternative embodiment of attaching the wings to the garment.

The wings 42, 44 attach the cups 5, 10 to the sides of the garment 20. The edge of the wing opposite the edge attached to the cup is, for example, sewn into the side seam of the garment. In a first arrangement, the wing is made of non-elastic fabric. In a second arrangement, the wing is made of an elastic fabric. In a third alternative arrangement, shown in FIG. 7, the lower edge 82, 84 of the wing 42, 44 is attached to a small piece of elastic material 43, 45 that is attached to the side of the garment.

The shoulder straps 46, 48 attach the cups to the garment shoulders 66, 68. Each shoulder strap is attached at a first end to a top section of the cup and also to the garment shoulder. The shoulder strap is for example sewn into the shoulder seam. One of ordinary skill in the art will understand that other types of attachment are possible. Unlike conventional support garments, the shoulder strap ends at the shoulder and does not continue down, or across, the wearer's back.

Figure 3:
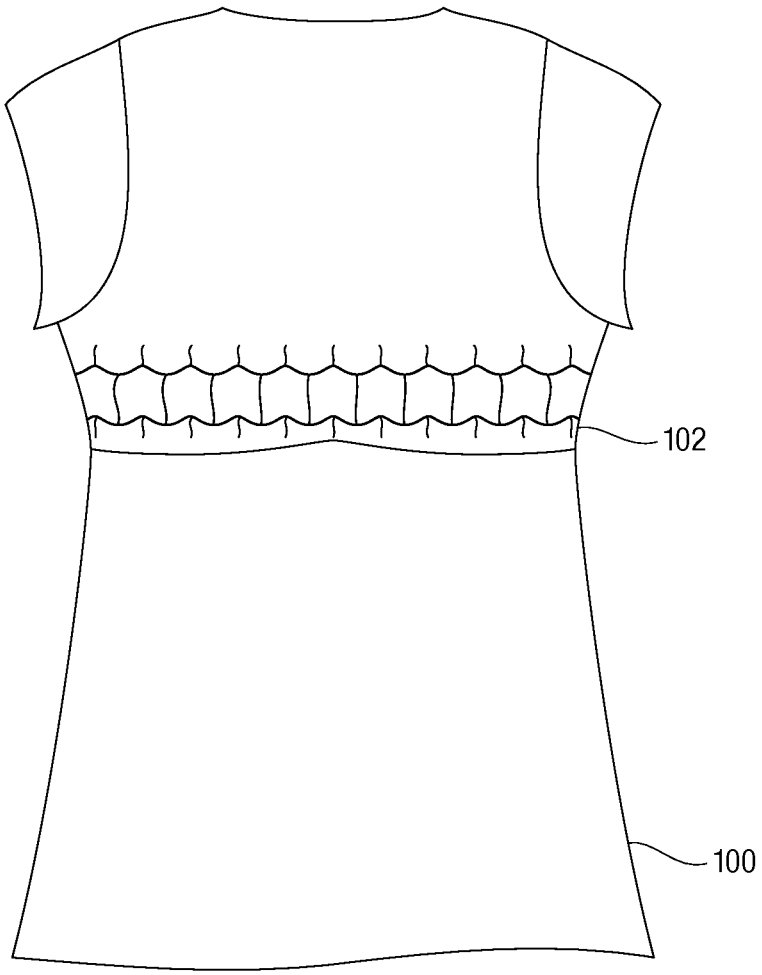
FIG. 3 is the back of the garment of FIG. 2 as seen from the inside.

FIG. 3 shows the back 100 of the garment 20 as seen from the inside. An elastic section 102 is incorporated into the back 100. The elastic section 102, also referred to as an elasticized strip, is, in a first embodiment, a piece of elastic material sewn to the garment back 100. In a second embodiment, the elasticized strip 102 is stitching on the garment back sewn with elastic thread. The elasticized strip is typically level with the wings 42, 44.

Figure 5:
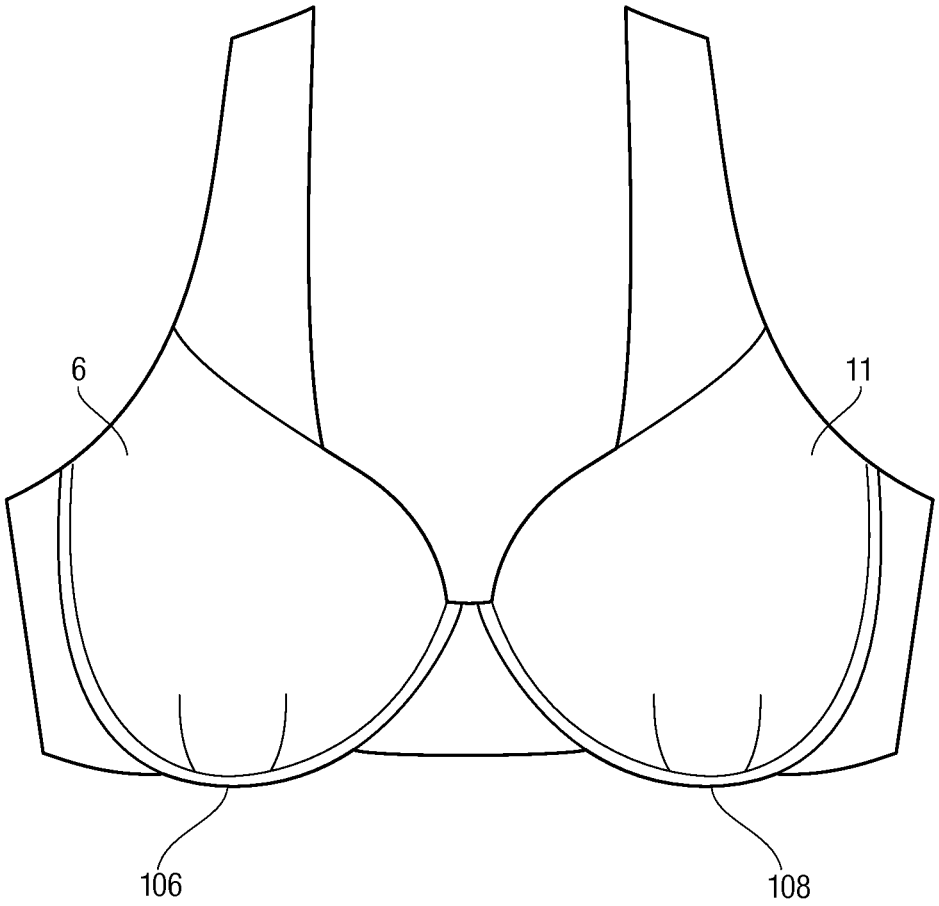
FIG. 5 shows an alternative embodiment of the breast support elements of FIG. 1.

In an alternative embodiment shown in FIG. 5, the cups 6, 11 are each formed as dome-shaped without sections. In the embodiment shown in FIG. 5, the foam is molded into a dome shape. The inner and outer layers of fabric are shaped to conform to the dome shape. Also shown in FIG. 5, each cup 6, 11 further includes a ridge 106, 108 located along the outside bottom edge of the cup. The ridge is constructed to be supportive but still flexible and provides a placement point for the fleece tape 62, 64.

Figure 6:
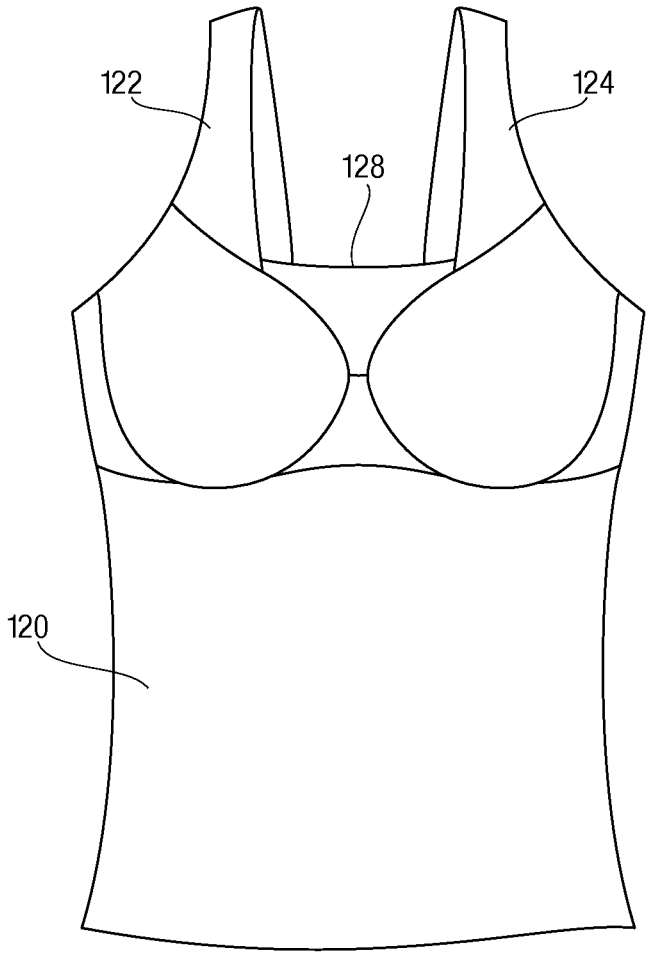
FIG. 6 shows an alternative embodiment of a garment according to principles of the invention.

FIG. 6 is a front view of a camisole 120 incorporating the breast support elements described above with regard to FIG. 1. In this embodiment, the shoulder straps 122, 124 extends over the shoulder and is attached to the back 128 of the camisole 120 rather than the shoulder.

The breast support elements are integrated into garments using soft elements. The garment is also wearable without fasteners or compression. Without the conventional metal hooks and eyes on the center of the back (as those found in many conventional bras), the comfort of the garment is improved. Incorporating the elastic at only the side seams and across the back is also an advantage compared to conventional garments such as tankinis, or camisoles having shelf bras, where elastic encircles and constrains the area of the body under the breasts.

To provide extra comfort to alternative embodiments, the width and thickness of the shoulder straps are enlarged and softened. These straps, enveloped in the fabric, help to relieve pressure and skin irritation in the shoulder area. Further, the shoulder strap may be constructed from elastic fabric.

The technological finishing of embodiments of the present invention includes double topstitching used for reinforcing the bottom parts of the cups, serving as a constructive feature and as a decorative element. Further, zigzag stitching is used for making the elastic shoulder straps, connecting details of the cups and for topstitching the strip of stretchable fabric through the back. Elastic stitches are used to connect details of the garment. Elastic stitches are important for stretch fabrics. One-line stitching is used to provide firm connection stitches for connecting the lining of the cups to the interfacing layer and outer layer.

Embodiments of the present invention are effective for a variety of breast sizes, particularly in the range of medium through extra-large sizes. The integrated breast support elements improve comfort and provide support in the breast area and in so doing improve the appearance of the female figure. In some embodiments, appearance is also enhanced by the use of a specific palette of prints and colors.

It is to be understood that the above-identified embodiments are simply illustrative of the principles of the invention. Various and other modifications and changes may be made by those skilled in the art which will embody the principles of the invention and fall within the spirit and scope thereof.

I claim:

1. A garment including a breast support function, comprising:

a garment front free of any elastic, compressive material, a garment back, a first side, a second side and first and second shoulder portions disposed and joined to define an inside of the garment;

a first and a second shaped cup for receiving breasts of a wearer of the garment, each shaped cup having an inner edge, an outer edge, a bottom edge and a top section;

a bridge located between the first and second shaped cups and attached to the inner edge of each shaped cup;

a first wing attached to the outer edge of the first shaped cup and a second wing attached to the outer edge of the second shaped cup, the first wing coupled to first side of the garment, the second wing coupled to the second side of the garment;

a first strap attached to the top section of the first shaped cup and a second strap attached to the top section of the second shaped cup, the first strap coupled to the first shoulder portion the second strap coupled to the second shoulder portion;

an elastic section integrated into the garment back starting at the first side and extending to the second side, the first and the second cups that contain the breasts are constructed of a nonelastic and noncompressive material, the first and second cups hold each breast contained therein securely in place providing noncompressive support without any underwires or a garment back fastener, and wherein the garment back elastic section that is attached to said first side and said second side secures said cup placement on said breast without direct compression to and about each of the breasts.

2. The garment of claim 1 wherein each shaped cup further comprises a lining layer, an outer fabric layer and a foam layer disposed between the lining layer and the outer fabric layer.

3. The garment of claim 1 wherein each shaped cup further comprises a first lower section and a second lower section to provide breast support and an upper section.

4. The garment of claim 2 wherein the foam layer is dome-shaped and the lining layer and outer layer are shaped to conform to the foam layer.

5. The garment of claim 2 wherein the foam is a polyester foam.

6. The garment of claim 1 wherein each shaped cup includes a piece of fleece tape along the bottom edge.

7. The garment of claim 1 wherein the bridge is made of a non-elastic material.

8. The garment of claim 1 wherein the first wing and the second wing each has a lower edge, and wherein the first wing and the second wing each further includes a piece of elastic material attached at the respective lower edges, the pieces of elastic material further coupled to the garment.

9. The garment of claim 1 wherein the elastic section integrated into the garment back is a strip of elastic material sewn to the garment back.

10. The garment of claim 1 wherein the elastic section integrated into the garment back is a section stitched with elastic thread.

11. The garment of claim 2 wherein the outer fabric layer is the garment front.

12. The garment of claim 1 wherein the elastic section is located in horizontal alignment with the first wing and the second wing.

* * * * *